US009597569B2

(12) United States Patent
Pederson

(10) Patent No.: US 9,597,569 B2
(45) Date of Patent: Mar. 21, 2017

(54) STREET HOCKEY PUCK

(71) Applicant: Tom Pederson, Bloomington, MN (US)

(72) Inventor: Tom Pederson, Bloomington, MN (US)

( * ) Notice: Subject to any disclaimer, the term of this patent is extended or adjusted under 35 U.S.C. 154(b) by 23 days.

(21) Appl. No.: 13/973,741

(22) Filed: Aug. 22, 2013

(65) Prior Publication Data

US 2015/0057116 A1 Feb. 26, 2015

(51) Int. Cl.
*A63B 67/14* (2006.01)
*A63B 71/04* (2006.01)

(52) U.S. Cl.
CPC ..... *A63B 67/14* (2013.01); *A63B 60/54* (2015.10); *A63B 71/04* (2013.01); *A63B 2102/22* (2015.10)

(58) Field of Classification Search
CPC ..... A63B 59/12; A63B 67/14; A63B 59/14
USPC ..... 273/108.1; 473/588
See application file for complete search history.

(56) References Cited

U.S. PATENT DOCUMENTS 2,467,043 A * 4/1949 Kotler ..... 473/588
3,704,891 A * 12/1972 Chiarelli ..... A63B 67/14 473/446
4,793,769 A 12/1988 Dolan
4,801,144 A 1/1989 De Masi, Jr. et al.
5,269,520 A * 12/1993 Vellines ..... 473/588
5,275,410 A 1/1994 Bellehumeur et al.
5,366,219 A * 11/1994 Salcer et al. ..... 473/588
5,518,238 A 5/1996 Hu et al.
5,531,442 A * 7/1996 Gill ..... 473/588
5,568,923 A 10/1996 Kahn et al.
5,792,012 A * 8/1998 Dudley ..... 473/588

* cited by examiner

*Primary Examiner* — Aarti B Berdichevsky
*Assistant Examiner* — Rayshun Peng
(74) *Attorney, Agent, or Firm* — Razmig H. Messerian; Loza & Loza, LLP

(57) ABSTRACT

An improved hockey puck for use on unsmooth surfaces such as streets and parking lots consisting of two generally equal sized disks. Sandwiched between the two disks is an energy absorbing member or members. Springs or foam washers can serve as these members. The two disks are loosely connected together so that only one will receive the direct impact from striking a imperfection in the street or other playing surface. The energy absorbing members dampen the forces transferred between the two puck disks. This results in a puck which can travel across rough surfaces with a greatly reduced likelihood of tumbling or bouncing. The improvement of the hockey puck specifically consists of the addition of a fortifying member positioned within either or both disks of the improved hockey puck.

18 Claims, 11 Drawing Sheets

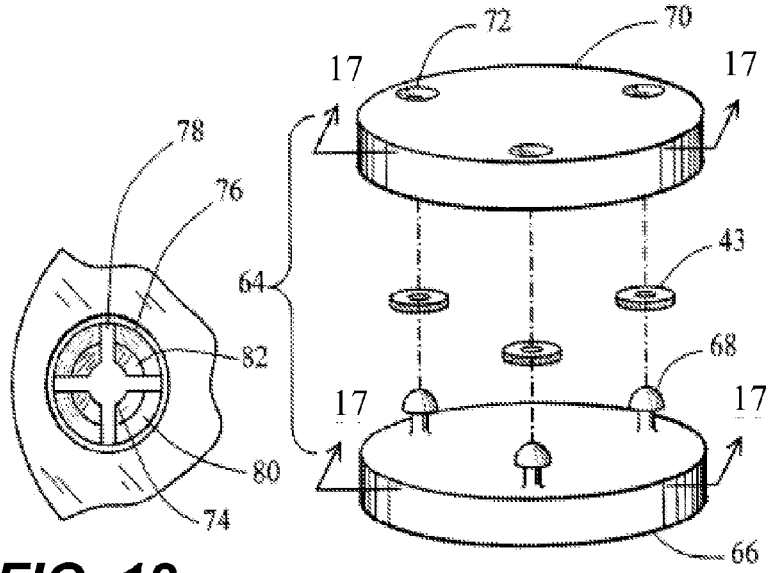
FIG. 18
(Prior Art)
FIG. 16
(Prior Art)
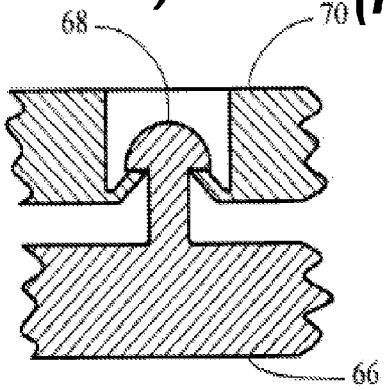
FIG. 17a
(Prior Art)
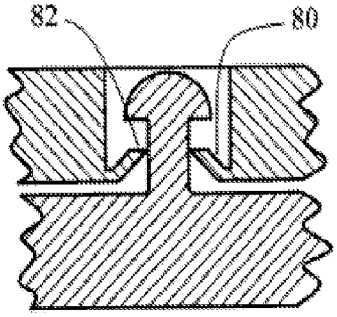
FIG. 17b
(Prior Art)

STREET HOCKEY PUCK

BACKGROUND

Field

The present invention relates to improved hockey pucks used on non-ice surfaces. In particular, the invention relates to improved street hockey pucks which are generally designed for use on flat semi-smooth to rough surfaces with an increased rigidity.

Background

The most readily available non-ice surfaces for playing hockey are asphalt and concrete. They are the streets, parking lots and outdoor play areas at schools and parks. Because of the traffic and weathering, these surfaces are generally semi-smooth to rough. Hockey pucks designed for play on smooth surfaces perform very erratically on these surfaces. There have been many relatively recent attempts to design a puck that would work on these surfaces. Many of these recently patented pucks have not yet become commercially available. Several may prove to be too costly to manufacture and sell.

An example of such a puck is described in U.S. Pat. No. 5,568,923 Kanh et al. (1996). The preferred embodiment of this invention consists of 89 individual parts including 30 rollers. Obviously many of these parts would be designed out when it is manufactured. But, the basic design of the puck requires the use of many rollers, and making and assembling them will be costly. Such a design is too costly to be able to sell to the price sensitive market of school aged children.

Like Kanh et al., many pucks have used wheels or spheres to improve puck performance on rough surfaces. An example of another patented puck which utilizes many wheels is U.S. Pat. No. 5,518,238 Hu et al. (1996). The various embodiments disclosed in this patent utilize from eight to thirty wheels or from five to eighteen spherical rollers. The probable cost of manufacturing some of these embodiments may equal the cost of manufacturing the Kanh et al. puck. Not every patented puck, that utilizes rolling members, include as many as do these two. Several use just three spheres. Three such pucks are U.S. Pat. No. 4,793,769 Dolan (1988), U.S. Pat. No. 4,801,144 De Masi, Jr. et al. (1989), and U.S. Pat. No. 5,531,442 Gill (1996). While clearly these three would not be as expensive to manufacture, they do share a problem common to all pucks with revolving parts. The problem is the bearing surfaces are vulnerable to dirt and grit.

The asphalt and concrete surfaces have dirt, dust, sand and sometimes water on them. These things will get into the bearings or bearing surfaces of these types of pucks. The wheels and spheres will soon stop rolling and will not provide the function that they were designed to do. Spheres are particularly prone to failure. First there is no mechanical advantage to the sphere bearing. It is dependent on there being less friction between the sphere and its adjacent cavity, than between the sphere and the playing surface. As it is being used, dirt and grit will get between the sphere and the cavity. The sphere will also become scratched and gouged by stones embedded in the playing surface. The spheres will stop turning freely and will not help the puck travel smoothly over the playing surface. The dirt and dust will generally soon render pucks with revolving parts no better than pucks that were solid to begin with.

Solid pucks are not costly to manufacture, and that may explain why they seem to be the most commonly sold. Solid pucks also perform very badly on semi-smooth or rough surfaces. On such surfaces the solid puck will not travel far before it bounces, tumbles or starts rolling. They are easily upset by playing surface imperfections while being shot, passed or even just being pushed along with a hockey stick. Stick handling, moving the puck side to side with the stick, is impossible since the solid puck will not stay flat on the playing surface. A typical solid puck is disclosed in U.S. Pat. No. 5,275,410 Bellehumeur et al. (1994). Like most, it is the about the same size and shape as an ice hockey puck. The main body is made up of an elastic material and embedded in this material are runners. The runners project out of the body and are made from materials with low friction and good wear characteristics.

The intended function of the projecting runners is to reduce friction. Their unintended function is to get caught in the many imperfections found in the playing surfaces. In concrete they cause the puck to trip on cracks and expansion joints. In asphalt the imperfections are usually holes which the projecting runners can easily fall into and upset the puck. On a surface like a nicely finished tennis court these solid pucks perform fine. On the typical surface available to most kids, most solid pucks are nearly unusable.

A further example is a hockey puck as defined under U.S. Pat. No. 5,792,012 by Dudley which described a hockey similar to the improved hockey puck of the present invention however without a fortifying member within either disks of the hockey puck. The hockey puck under Dudley cannot withstand extreme pressure that might be encountered when a player deploys a slap shot. The presence of the fortifying member allows for the improved hockey puck to withstand such force encountered when a player hits a slap shot.

SUMMARY

The improved puck of this invention is essentially the same shape as an ice hockey puck with fortifying members allowing for increased stress to be applied to the improved puck through the presence of the fortifying members. It can be made the same size as an ice hockey puck, three inches in diameter by one inch high, and it will perform very well. Improved performance can be obtained by slightly increasing the diameter to 3.2 inches and slightly reducing the height to 0.9 inches. The improved puck consists of two generally cylindrical shaped disks. In some embodiments the two disks are identical. In the remaining embodiments the differences are primarily involved with different methods of fastening the two disks together as well as the addition of a fortifying member within either or both of the disks.

The two disks are loosely connected together so that the two cylindrical disks are coaxial. Semi-tubular rivets or similar means can be used to connect the two disk of the puck together. When assembled the two disks are separated by a small distance, approximately an eighth of an inch. Held in the space between the two disks are energy absorbing foam or springs. As the improved puck slides across a rough surface it will encounter many imperfections. When the bottom half strikes the imperfection its course is altered upward. As it moves upward it will compress the spring or foam above it. The spring or foam absorbs the sudden shock of hitting the imperfection. The result is a softer collision with imperfections. If the imperfection is large enough, then the puck will lift off of the playing surface. When the puck lands back upon the playing surface the springs or foam help absorb the force of the landing. The springs or foam dampen every contact the puck has with the surface, which greatly reduces the incidents of bouncing, tumbling and rolling.

Therefore, it is an object of the present invention to provide an improved puck that will rarely bounce, tumble, or roll when used on asphalt, concrete or other unsmooth surfaces and that will not shatter when increased forces are applied to the improved puck.

Because it slides in a controlled predictable manner, a further object is to provide an improved puck that can be stick handled on unsmooth surfaces as well as have a fortifying member within either or both disks of the improved puck.

A large proportion of puck purchases are by children, so a third object is to provide an improved puck that can be affordably priced and durable.

A fourth object is to provide an improved puck that when shot or passed will travel along a straight predictable path.

These and other objects and advantages of the present invention, will no doubt become obvious to those of ordinary skill in the art, after having read the following detailed description of the embodiments, which are illustrated in the various drawing figures.

BRIEF DESCRIPTION OF THE DRAWINGS

It will now be convenient to describe the invention with particular reference to one embodiment of the present invention. It will be appreciated that the drawings relate to one embodiment of the present invention only and are not to be taken as limiting the invention.

FIG. 16 is an exploded perspective view of a hockey puck found in the prior art that can be modified to include a fortifying member.

FIG. 17*a* is a fragmentary sectional view taken along the line 17-17 of the puck illustrated in FIG. 16 showing the relative positions of the connectors when the foam washers not compressed.

FIG. 17*b* is a fragmentary sectional view taken along the line 17-17 of the puck illustrated in FIG. 16 showing the relative positions of the connectors when the foam washers are compressed.

FIG. 18 is a detailed fragmentary view of the female connector found in the prior art.

DETAILED DESCRIPTION

The present invention will now be described more fully hereinafter with reference to the accompanying drawings, in which preferred and other embodiments of the invention are shown. No embodiment described below limits any claimed invention and any claimed invention may cover processes or apparatuses that are not described below. The claimed inventions are not limited to apparatuses or processes having all the features of any one apparatus or process described below or to features common to multiple or all of the apparatuses described below. It is possible that an apparatus or process described below is not an embodiment of any claimed invention. The applicants, inventors or owners reserve all rights that they may have in any invention claimed in this document, for example the right to claim such an invention in a continuing application and do not intend to abandon, disclaim or dedicate to the public any such invention by its disclosure in this document.

According to one aspect, the present invention is an improved street hockey puck designed for play on rough surfaces and for increased rigidity when extreme forces are applied to the puck.

At least eight embodiments are presented in the following description. All of the embodiments consist of two, generally equal sized, disks that are connected to each other. The disks are not tightly connected together. The connectors allow them to move relative to each other. In at least seven embodiments described below, energy absorbing material or parts are sandwiched between the two disks.

Figure 1A:
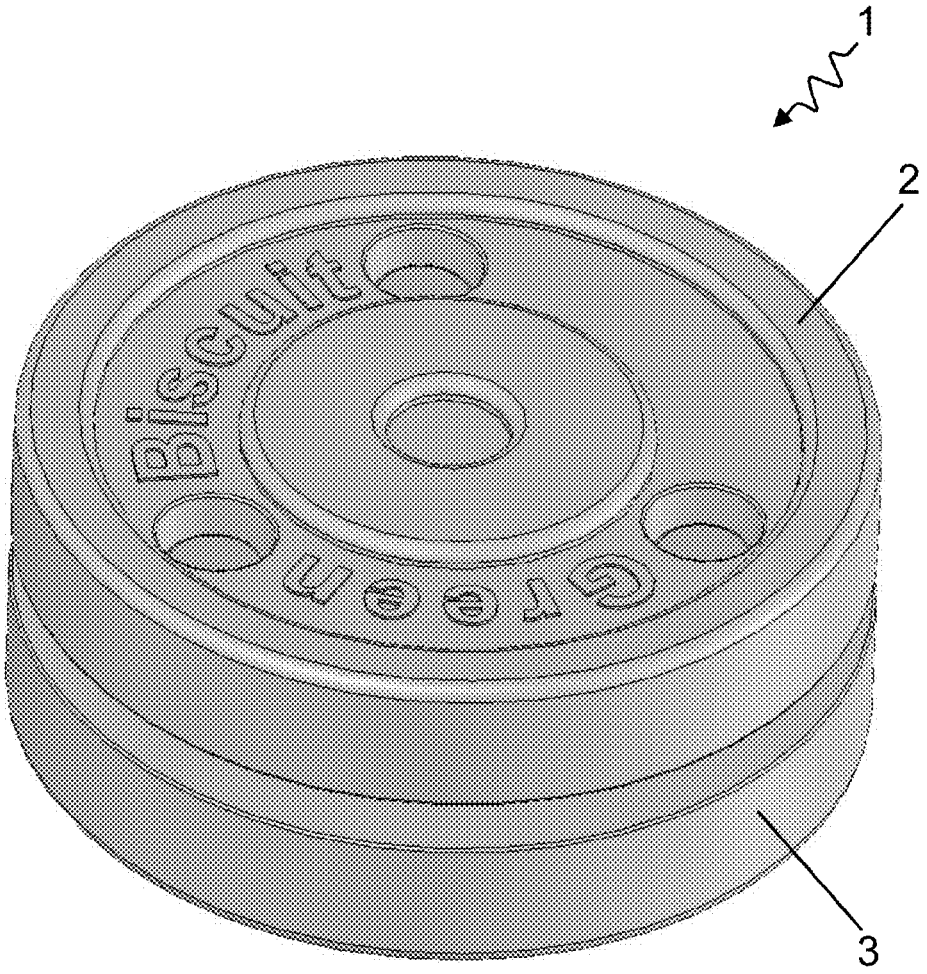
FIG. 1*a* is a perspective view an improved street hockey puck according to a first embodiment of the present invention.
Figure 1B:
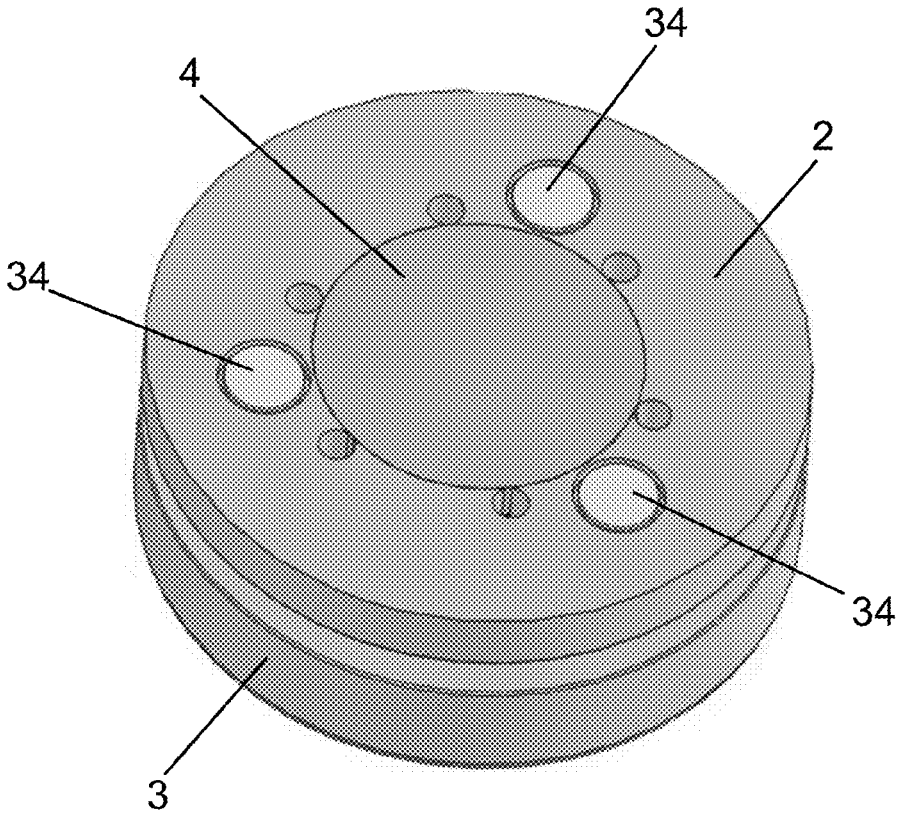
FIG. 1*b* is a cross-sectional perspective view of a top disk and a perspective view of a second disk of an improved street hockey puck according to a first embodiment of the present invention.
Figure 1C:
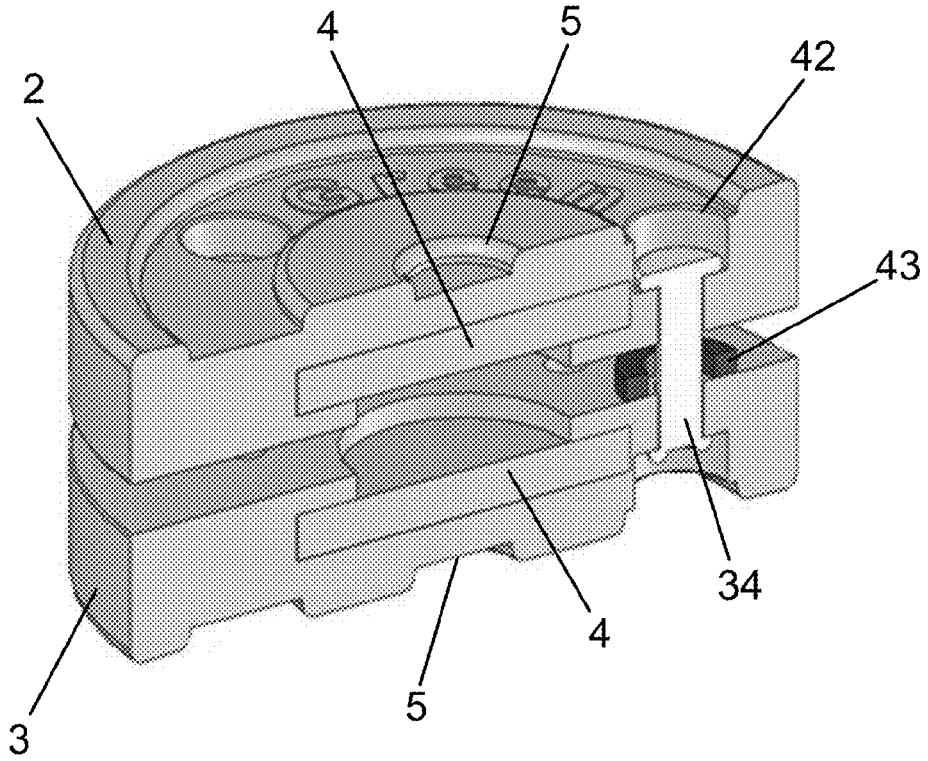
FIG. 1*c* is a cross-sectional view of an improved street hockey puck according to a first embodiment of the present invention.

A perspective view of a first embodiment of an improved hockey puck 1 is illustrated in FIG. 1*a*. The first embodiment is made up of a first disk 2 and a second disk 3. With reference to FIG. 1*b*, the first disk 2 has a fortifying member 4 positioned in the central area of the first disk 2. The fortifying member 4 allows for increased rigidity of the improved hockey puck since it reinforces the inner central area of disk 2. Without said fortifying member 4, the improved hockey puck cannot withstand forces as encountered when a slap shot is applied to the puck by an individual. The fortifying member 4 can be made of various materials such as steel, aluminum, iron for example. With reference to FIG. 1*c*, the improved hockey puck 1 has fortifying member 4 in both disks 2 and 3. The fortifying member 4 is positioned within the central region of disks 2 and 3. Disks 2 and 3 have openings 5 which exposes fortifying member 4.

With further reference to FIGS. 1*b* and 1*c*, an improved hockey puck of the present invention is shown having disks 2 and 3 have sunk holes 42 allowing for the insertion of semi tubular rivets 34 which hold the disks together to form an improved hockey puck. A small foam washer 43 is also present between disks 2 and 3 allowing for a separation of the respective disks. The width and radius of the fortifying member 4 can be increased or decreased based on the desired rigidity for the improved hockey puck. The presence of openings 5 is not required to assure increased rigidity of the improved hockey puck.

Figure 2:
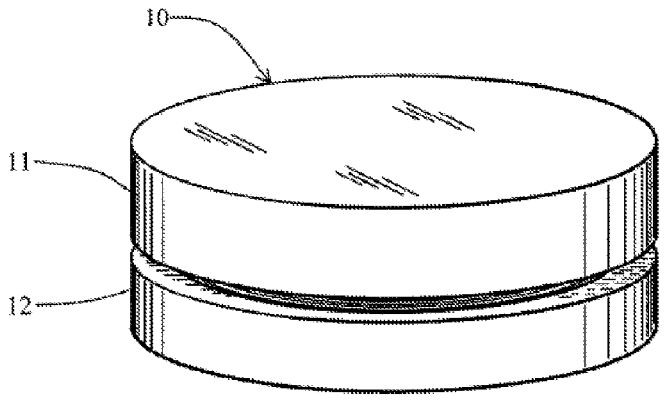
FIG. 2 (Prior Art)
FIG. 2 is a perspective view of a hockey puck found in the prior art that can be modified to include a fortifying member.
Figure 3:
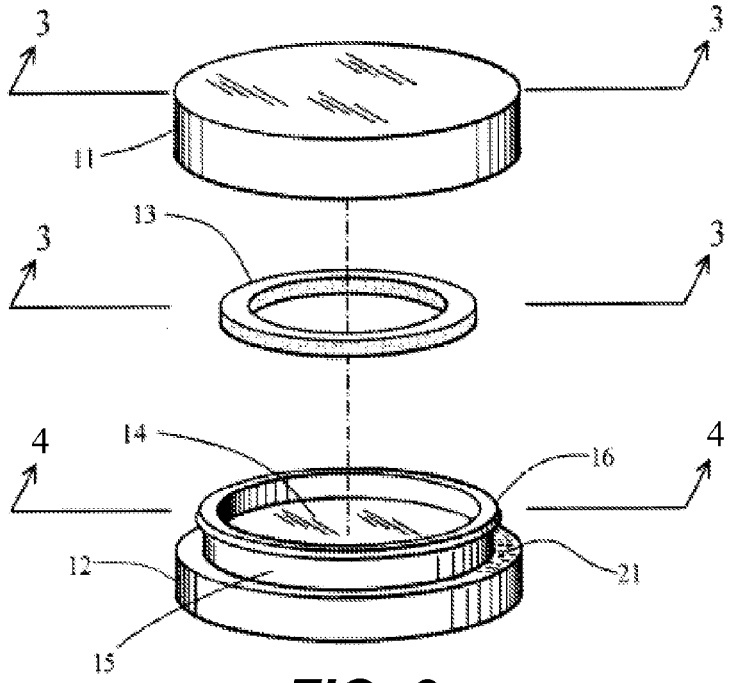
FIG. 3 (Prior Art)
FIG. 3 is an exploded perspective view of the hockey puck illustrated in FIG. 2.
Figure 4:
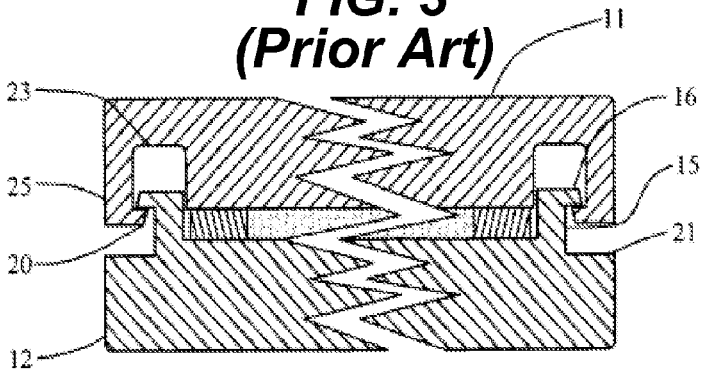
FIG. 4 (Prior Art)
FIG. 4 is a fragmentary sectional view taken along the line 4-4 of FIG. 3.

A perspective view of a hockey puck 10 found in the prior that may be modified to include a fortifying member is illustrated in FIG. 2. The hockey puck 10 is made up of a female disk 11 and a male disk 12. With reference to FIGS. 3 and 4, between the two disks is a foam ring 13. A suitable foam material is polyurethane that can be depressed 25% with a force less than one pound per square inch. The foam ring 13 is located within a cavity 14 formed by the circular wall 15. This wall 15 is part of the male disk half 12. Attached to the wall is a beveled external circular catch 16.

Within the female disk 11, directly opposite the external circular catch 16 is a circular channel 23. At the mouth of this channel 23, extending from the outside wall 25, is a beveled internal catch 20. During assembly of the puck the axes of the two disks are aligned and the disks are pushed together. The beveled external catch 16 presses against the beveled internal catch 20. This causes the outside wall 25 to flex and the two catches to slide past each other. At that point the wall returns to its relaxed position and the two disks are locked together. As seen in FIG. 3 the foam ring 13 keeps the two disks from completely coming together. The channel 23 is sufficiently deep so that the circular wall 15 does not strike the female disk 11 when the disk collapses. Likewise the shoulder 21 in the male disk 12 prevents the outside wall 25 from striking the male disk 12. A fortifying member as described under FIGS. 1*b* and 1*c* could be positioned within the central region of either disk 11 or 12 or in both which would provide an improved hockey puck according to a second embodiment of the present invention.

Figure 5:
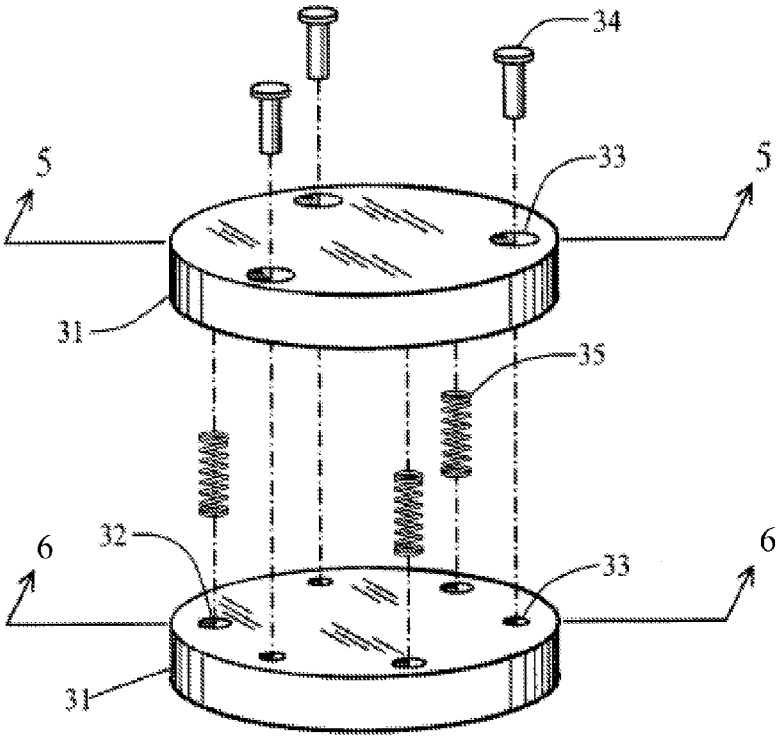
FIG. 5 (Prior Art)
FIG. 5 is an exploded perspective view of a hockey puck found in the prior art that can be modified to include a fortifying member.
Figure 6:
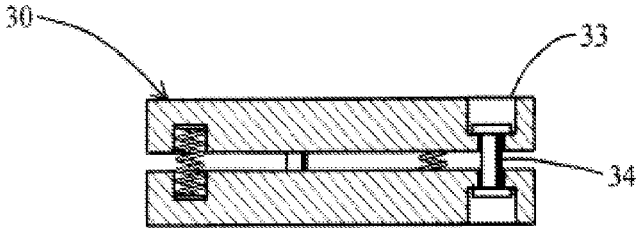
FIG. 6 (Prior Art)
FIG. 6 is a sectional view taken along the line 6-6 of FIG. 5.

The disks in the prior art hockey puck 30 of FIG. 5 neither male or female. As shown in the exploded perspective view in FIG. 5, the two disks 31 in this embodiment are identical. These disks 31 are cylinders with six holes in them. Three of the holes 33 are counter sunk through holes and the other three are blind holes 32. Three springs 35 are captured and held within the blind holes 32. Semi-tubular rivets 34 are inserted into the counter sunk through holes 33. These rivets are crimped and hold the puck together as shown in FIG. 6. FIG. 6 is a cross sectional view of the assembled hockey puck 30. As can be seen in FIG. 6 after the puck has been assembled the two disks are not in direct contact. The springs 35 keep the two disks apart. The spring constant of these springs is relatively light and the disks can be pushed together with only about five ounces of force. A fortifying member as described under FIGS. 1*b* and 1*c* could be inserted into the central region of disks 31 or could be inserted into only one disk 31 which would provide an improved hockey puck according to a third embodiment of the present invention.

Figure 7:
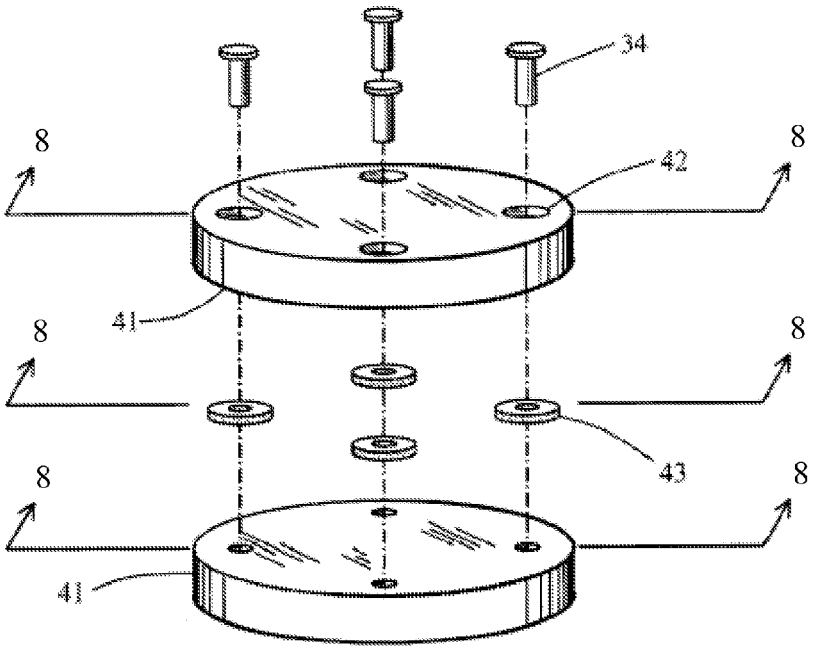
FIG. 7 (Prior Art)
FIG. 7 is an exploded perspective view of a hockey puck found in the prior art that can be modified to include a fortifying member.
Figure 8:
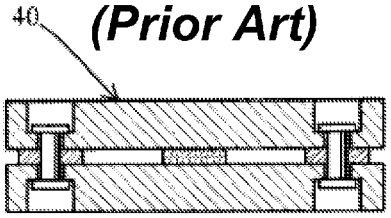
FIG. 8 (Prior Art)
FIG. 8 is a sectional view taken along the line 8-8 of FIG. 7.

Another hockey puck 40 of the prior art is shown in FIGS. 7 and 8. In place of springs, small foam washers 43 are used to separate the disks 41. The force required to depress this foam is very light. A force of less than one pound per square inch will compress the foam 25%. One suitable foam material for the washers is polyurethane. The two disks 41 in this embodiment are identical. They are connected together with four semi-tubular rivets 34. The rivets are mounted in the counter sunk holes 42. A fortifying member as described under FIGS. 1*b* and 1*c* could be inserted into the central region of disks 41 or could be inserted into only one disk 41 which would provide an improved hockey puck according to a fourth embodiment of the present invention.

Figure 9:
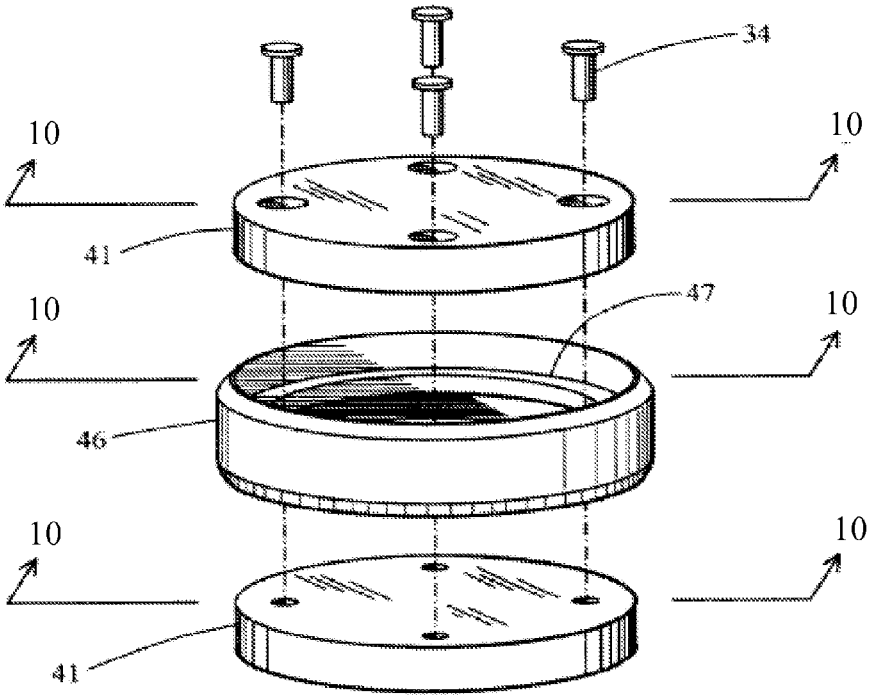
FIG. 9 (Prior Art)
FIG. 9 is an exploded perspective view of a hockey puck found in the prior art that can be modified to include a fortifying member.
Figure 10:
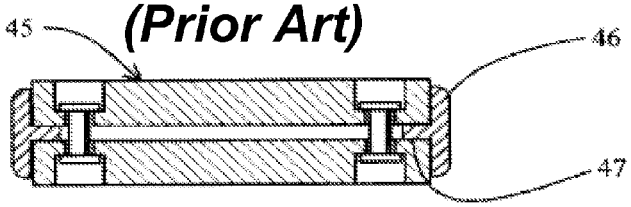
FIG. 10 (Prior Art)
FIG. 10 is a sectional view taken along the line 10-10 of FIG. 9.

Another hockey puck 45 of the prior art is shown in FIGS. 9 and 10. The hockey puck 45 of FIGS. 9 and 10 is identical to the hockey puck 40 of FIGS. 7 and 8 with the exception of the foam separating the disks. The foam is a beveled ring 46 with an internal flange 47. The flange 47 separates the two disks 41. As can be seen in FIG. 10, when the puck is assembled the foam ring 46 covers most of the outside circumference of the puck. A fortifying member could be inserted into the central region of disks 31 or could be inserted into only one disk 31 which would provide an improved hockey puck. A fortifying member as described under FIGS. 1*b* and 1*c* could be inserted into the central region of disks 41 or could be inserted into only one disk 41 which would provide an improved hockey puck according to a fifth embodiment of the present invention.

Figure 11:
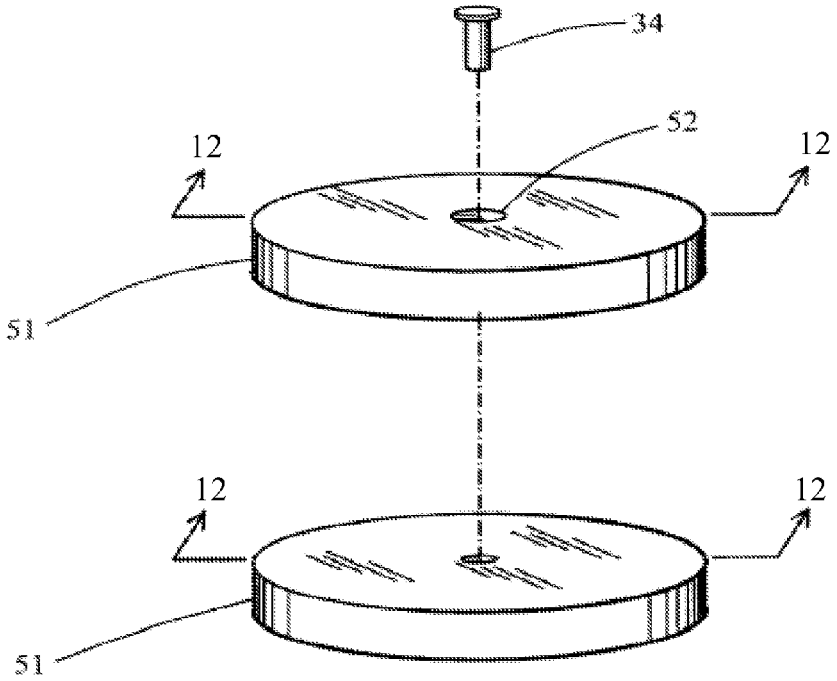
FIG. 11 (Prior Art)
FIG. 11 is an exploded perspective view of a hockey puck found in the prior art that can be modified to include a fortifying member.
Figure 12:
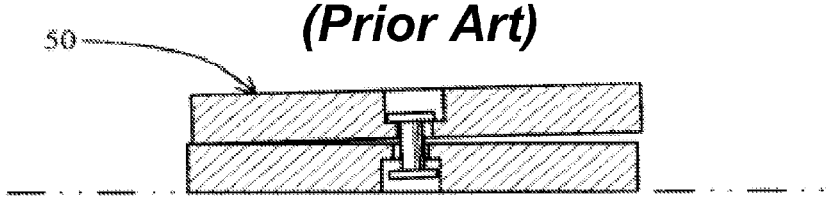
FIG. 12 (Prior Art)
FIG. 12 is a sectional view taken along the line 12-12 of FIG. 11.

Another hockey puck 50 of the prior art is shown in FIGS. 11 and 12. The two disks 51 of this embodiment are also identical. They are connected by one rivet 34 in the counter sunk hole 52. As seen in FIG. 12 this hole is slightly oversized. There are no springs or foam separating the two disks 51 in this embodiment the loose connection between the two disks allows them to successfully slide across rough surfaces without upsetting. As illustrated in FIG. 12, as they slide across a surface S they just rattle along over the imperfections. A fortifying member as described under FIGS. 1*b* and 1*c* could be inserted into the central region of disks 51 or could be inserted into only one disk 51 which would provide an improved hockey puck according to a sixth embodiment of the present invention.

Figure 13:
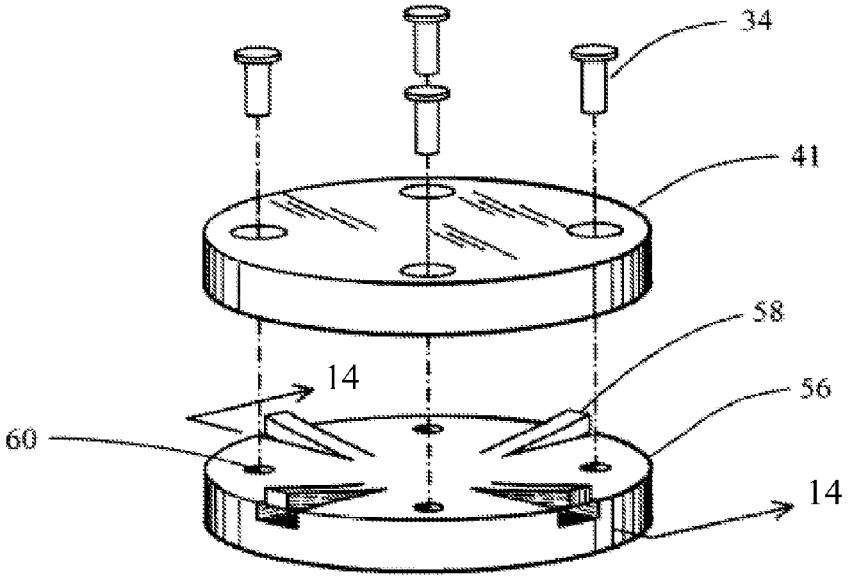
FIG. 13 (Prior Art)
FIG. 13 is an exploded perspective view of a hockey puck found in the prior art that can be modified to include a fortifying member.
Figure 14:
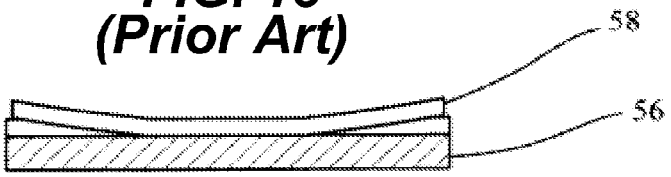
FIG. 14 (Prior Art)
FIG. 14 is a sectional view taken along the line 14-14 of FIG. 13.
Figure 15:
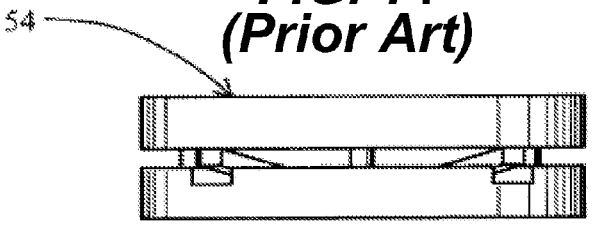
FIG. 15 (Prior Art)
FIG. 15 is a side elevational view of the puck illustrated in FIG. 13.

The disks of all of the puck embodiments could be made with injection molded plastic such as high density polyethylene (HDPE). By proper design, the injection molded disks could also incorporate the other parts of the puck. Another hickey puck 54 of the prior art illustrated in FIGS. 13, 14, and 15 discloses one method of incorporating springs into one of the puck disks. The disk 56 has four channels 59 on its inner surface. The channels radiate out from the axis of the disk. Within each channel is a flexible cantilever arm 58. The cantilever arms 58 are attached to the main body of the disk at the centermost end of each channel 59. From there the cantilever arms radiate outward from the axis. As they radiate outward they also bend away from their respective channels. Thus when the puck is assembled, FIG. 15, the flexible cantilever arms serve as springs between the two disks 41 and 56. A fortifying member 4 could be inserted into the central region of disks 31 or could be inserted into only one disk 31 which would provide an improved hockey puck. A fortifying member as described under FIGS. 1*b* and 1*c* could be inserted into the central region of disks 41 and 56 or could be inserted into only one disk either 41 or 56 which would provide an improved hockey puck according to a seventh embodiment of the present invention.

The second part that could be incorporated into an injection molded puck disk is the connector. Called snap joint assemblies, they are very commonly used to assemble injection molded parts. The hockey puck 10 shown in FIG. 2 used an inseparable annular snap joint assembly. Another snap assembly is used in the embodiment shown in FIGS. 16, 17*a*, 17*b*, and 18. This embodiment uses a modified ball and socket snap fit assembly. Instead of a complete ball, a half ball 68 is used for assembly of this puck. Three of these 68 are attached to the disk 66. Within disk 70 are three corresponding sockets 72 for receiving the half balls 68.

Within the socket 72 are four cantilever beams 76 arranged around a circular opening 74. The beams are separated by a slit 78 and the circular opening 74. The beams are attached near the inner end of the cylindrical disk 70 and extend 80 toward the outer end of the cylindrical disk. The half ball 68 rests against the flat end 82 of the beam when the two disks are fully separated, the condition shown in FIG. 17*a*. FIG. 17*b* shows the snap assembly parts when the two disks are only partially separated, which can occur when the puck is traveling over a rough surface. For purposes of clarity the foam washer 43 was not shown in FIGS. 17*a* and 17*b*. A fortifying member as described under FIGS. 1*b* and 1*c* could be inserted into the central region of disks 66 and 70 or could be inserted into only one disk either 66 or 70 which would provide an improved hockey puck according to an eighth embodiment of the present invention.

The improvement of including fortifying member 4 within all of the embodiments except the first embodiment would be within the knowledge of a worker skilled in the relevant art after having the knowledge of the first embodiment as described.

Operation

The flat contact surface of this puck allows it to slide over many of the imperfections in the surfaces on which it is used. With imperfections that do effect its travel, the effect is lessened by the two piece design. With this design only half of the puck ever makes direct contact with an imperfection. This results in the puck only receiving half of the possible deflecting energy caused by the imperfection. When the spring or foam compresses and expands, it further dissipates some of this deflecting energy before it is transmitted to the other half of the puck. So imperfections probably deliver less than half as much deflecting energy to this puck compared to a puck of solid design.

Some imperfections will cause the puck to lift off of the playing surface. When this happens the benefit of this design again comes into effect. When the lifted puck lands back on the surface the bottom half makes first contact. It hits the ground with only half of the pucks energy. The energy of the bottom half s rebound from the surface will be about half of what it would be if the puck was solid. As the bottom is moving up the top is still moving down. Together they compress the spring or foam which dissipates some of their energy. Additionally, the effect of the top moving down cancels much of the energy in upward moving bottom, effectively neutralizing the deflecting forces. The effect of the two halves often moving in opposite directions, may be the primary factor in the pucks outstanding performance on rough surfaces. The hockey puck 45 shown in FIGS. 9 and 10 does not have energy absorbing foam or springs yet it performs at least half as well at the embodiments that do have foam or springs.

In comparison, solid pucks perform many times worse on these same rough surfaces. This suggests that the bouncing and tumbling of these solid pucks is not a result of the first imperfection they hit. Instead, it suggest that the violence of each contact with the rough surface multiplies. After a few of these increasingly violent surface contacts the solid puck is tumbling, bouncing, or rolling on its edge.

Considerations

There is no ideal street puck that fits every situation. The character of the street hockey playing surfaces vary from smooth to rough. Also, the needs of players can vary. Some ice hockey players may want a heavily weighted street puck to practice their shooting. Such a puck would be too heavy to use in a game. Price and performance requirements also vary. The highest performing puck would usually not be needed in a kids' neighborhood game. They would more likely be interested in a good puck at a lower price. The serious ice hockey player will want to use a puck that performs as close as possible to the performance of ice hockey pucks on ice. Practice time on ice is limited and expensive. A higher cost, high performance, street hockey puck would probably save them money.

There is a range of cost and performance with the different embodiments of the present invention. The characteristics of each embodiment can also be tailored by changes in the pucks weight and the compressibility constant of the foam or springs. The number of connectors and springs or foam washers is not limited by the embodiments shown. For example, the hockey puck 10 shown in FIG. 2 shows a puck with three individual springs, but a puck can also be made with one or four springs. The number of connectors used can also be varied from one, three or four. Two connectors or springs would probably not be desirable and more than four would probably offer no measurable benefit. The puck disks can be made from several different plastics including acetal, nylon, and high density polyethylene. The choice of plastic will affect the pucks weight, durability, performance, and cost.

While the present embodiments of this invention have been described, it should be understood that various changes, adaptations and modifications may be made therein without departing from the spirit of the invention and the scope of the appended claims. Thus the scope of the invention should be determined by the appended claims and their legal equivalents, rather than by the examples given.

What is claimed is:

1. A hockey puck for play on non-ice surfaces comprising:

(a) a first cylindrical member having first and second generally parallel ends, the second generally parallel ends of the first cylindrical member having a first central opening;

(b) a second cylindrical member having first and second generally parallel ends and with a diameter generally equal to said first cylindrical member, the first generally parallel end of the second cylindrical member having a second central opening;

(c) a connective means for loosely joining said first and second cylindrical members so that their respective ends are generally parallel and that their respective axes are substantially coincident when said puck is at rest; and (d) an undivided and solid fortifying member positioned within each central portion of the first and second cylindrical members providing increased rigidity to the first and second cylindrical members, a bottom surface of the undivided and solid fortifying member positioned within the first cylindrical member exposed at the first central opening of the second generally parallel end of the first cylindrical member, a top surface of the undivided and solid fortifying member positioned within the second cylindrical member exposed at the second central opening of the first generally parallel end of the second cylindrical member.

2. The hockey puck as in claim 1, wherein said connective means allows said first cylindrical member to move relative to said second cylindrical member a predetermined distance whereby reducing the likelihood of said hockey puck to bounce or tumble as it travels across said non-ice surface.

3. The hockey puck as in claim 1, wherein said connective means allows the angle between the axis of said first cylindrical member and the ends of said second cylindrical member to vary a predetermined number of degrees, whereby reducing the likelihood of said hockey puck to bounce or tumble as it travels across said non-ice surface.

4. The hockey puck as in claim 1, wherein said connective means allows the axis of said first cylindrical member to move at right angles to the axis of said second cylindrical member a predetermined distance, whereby reducing the likelihood of said hockey puck to bounce or tumble as it travels across said non-ice surface.

5. The hockey puck as in claim 1, further including an energy absorbing means sandwiched between said first and second cylindrical members.

6. The hockey puck as in claim 5, wherein said energy absorbing means is one or more springs.

7. The hockey puck as in claim 5, wherein said energy absorbing means is one or more foam members.

8. The hockey puck as in claim 5, wherein said energy absorbing means is molded into one or both of said cylindrical members.

9. The hockey puck as in claim 1, wherein said connective means includes one or more through holes in each said cylindrical member and a rivet in each corresponding pair of said holes.

10. The hockey puck as in claim 1, wherein said connective means includes a screw.

11. The hockey puck as in claim 1, wherein said connective means is molded into said cylindrical members.

12. A hockey puck for play on non-ice surfaces comprising: (a) a first cylindrical member having first and second generally parallel ends, the second generally parallel end of the first cylindrical member having a first central opening; (b) a second cylindrical member having first and second generally parallel ends and with a diameter generally equal to said first cylindrical member, the first generally parallel end of the second cylindrical member having a second central opening; (c) one or more counter-sunk through holes in each of said cylindrical members through which rivets loosely join said cylindrical members so that their respective ends are generally parallel and that their respective axes are substantially coincident when said puck is at rest; (d) one or more energy absorbing foam members sandwiched between said cylindrical members whereby the shock of striking imperfections in the playing surface is dampened in order to reduce the likelihood of said puck to bounce or tumble; and (e) an undivided and solid fortifying member positioned within each central portion of the first and second cylindrical members providing increased rigidity to the first and second cylindrical members, a bottom surface of the undivided and solid fortifying member positioned within the first cylindrical member exposed at the first central opening of the second generally parallel end of the first cylindrical member, a top surface of the undivided and solid fortifying member positioned within the second cylindrical member exposed at the second central opening of the first generally parallel end of the second cylindrical member.

13. A hockey puck for play on non-ice surfaces comprising: (a) a first cylindrical member having first and second generally parallel ends, second generally parallel end of the first cylindrical member having a first central opening; (b) a second cylindrical member having first and second generally parallel ends and with a diameter generally equal to said first cylindrical member, the first generally parallel end of the second cylindrical member having a second central opening; (c) a connective means molded into said first and second cylindrical members for loosely joining said members so that their respective ends are generally parallel and that their respective axes are substantially adjacent when said puck is at rest; (d) an energy absorbing means molded into one or both of said cylindrical members and said energy absorbing means located between said cylindrical members; and (e) an undivided and solid fortifying member positioned within each central portion of the first and second cylindrical members providing increased rigidity to the first and second cylindrical members, a bottom surface of the undivided and solid fortifying member positioned within the first cylindrical member exposed at the first central opening of the second generally parallel end of the first cylindrical member, a top surface of the undivided and solid fortifying member positioned within the second cylindrical member exposed at the second central opening of the first generally parallel end of the second cylindrical member.

14. The hockey puck of claim 13, wherein the connective means is an inseparable snap joint.

15. The hockey puck of claim 13, wherein the energy absorbing means is a cantilever arm.

16. The hockey puck of claim 1, wherein the first generally parallel end of the first cylindrical member includes a raised annular ridge that bounds the first central opening of the first cylindrical member's first generally parallel end.

17. The hockey puck of claim 12, wherein the first generally parallel end of the first cylindrical member includes a raised annular ridge that bounds the first central opening of the first cylindrical member's first generally parallel end.

18. The hockey puck of claim 13, wherein the first generally parallel end of the first cylindrical member includes a raised annular ridge that bounds the first central opening of the first cylindrical member's first generally parallel end.

* * * * *